US007339102B2

(12) United States Patent
Folmar et al.

(10) Patent No.: US 7,339,102 B2
(45) Date of Patent: Mar. 4, 2008

(54) CAM ACTIVATED TREMOLO BRIDGE

(76) Inventors: Joe Folmar, 3755 Beebe Rd., Newfane, NY (US) 14108; Keith Pate, 130 Locust St., Lockport, NY (US) 14094

( * ) Notice: Subject to any disclaimer, the term of this patent is extended or adjusted under 35 U.S.C. 154(b) by 0 days.

(21) Appl. No.: 11/188,216

(22) Filed: Jul. 21, 2005

(65) Prior Publication Data

US 2006/0117930 A1 Jun. 8, 2006

Related U.S. Application Data

(60) Provisional application No. 60/590,424, filed on Jul. 22, 2004.

(51) Int. Cl.
*G10D 3/00* (2006.01)

(52) U.S. Cl. ..... 84/313

(58) Field of Classification Search ..... 84/313
See application file for complete search history.

(56) References Cited

U.S. PATENT DOCUMENTS

| | | | | | |
|---|---|---|---|---|---|
| 4,686,883 | A * | 8/1987 | Piche et al. | 84/313 |
| 4,688,461 | A * | 8/1987 | Stroh | 84/298 |
| 4,903,568 | A * | 2/1990 | Itoh | 84/313 |
| 5,392,680 | A * | 2/1995 | Stets | 84/313 |
| 5,747,713 | A * | 5/1998 | Clement | 84/313 |
| 5,824,925 | A * | 10/1998 | Yost | 84/313 |
| 5,986,190 | A * | 11/1999 | Wolff et al. | 84/297 R |
| 6,100,459 | A * | 8/2000 | Yost | 84/313 |
| 6,797,870 | B2 * | 9/2004 | Kang | 84/313 |
| 6,867,354 | B2 * | 3/2005 | Shimooka et al. | 84/312 R |
| 6,875,911 | B2 * | 4/2005 | Schryer | 84/313 |
| 6,972,360 | B1 * | 12/2005 | Ekin | 84/312 R |
| 6,989,483 | B2 * | 1/2006 | Ramsay | 84/313 |
| 7,009,096 | B2 * | 3/2006 | Hirayama | 84/313 |
| 2003/0183062 | A1 * | 10/2003 | Schryer | 84/313 |
| 2005/0076766 | A1 * | 4/2005 | Didan | 84/313 |
| 2006/0117930 | A1 * | 6/2006 | Folmar et al. | 84/313 |

* cited by examiner

*Primary Examiner*—Lincoln Donovan
*Assistant Examiner*—Robert W Horn

(57) ABSTRACT

An improved reverse tremolo bridge including a base plate attached to a guitar body, a camshaft connected to a slide plate, and cam stops connected to the base plate. Strings for the guitar are engaged to respective string saddles and pass through respective slots in the base plate and slide plate to a spring block. The string saddles are connected to the slide plate. The tension of the strings draws the slide plate toward the head of the guitar and hence brings the camshaft into contact with the cam stops. A handle is used to rotate the camshaft. The camshaft surfaces in contact with the cam stops are formed so that the longitudinal axis of the camshaft moves closer or further from the head of the guitar as the camshaft rotates. The slide plate moves with the camshaft, thereby decreasing or increasing, respectively, the tension on the strings.

14 Claims, 11 Drawing Sheets

CAM ACTIVATED TREMOLO BRIDGE

This application is based on and claims priority to that Provisional Application filed Jul. 22, 2004 in the United States Patent and Trademark Office, Application No. 60/590,424

BACKGROUND OF THE INVENTION

1. Field of the Invention

This invention relates generally to double-acting bridge attachments for a guitar or other stringed instrument, and, even more particularly, to a cam activated tremolo bridge for a guitar or other stringed instrument.

2. State of the Art

"Floating" tremolo bridges are well known. The original patent to Fender in U.S. Pat. No. 2,741,146 includes a lever or a handle connected to a spring counterbalance or "floating" bridge pivotal on a knife-edged support. In such a mechanism, a pivot point is established, and the bridge pivots about that point. A counter spring is generally utilized to counteract the pull of the strings on the bridge. A lever or handle is provided for facilitating the pivoting of the bridge, while the user simultaneously plays the instrument. The guitar player manipulates the handle to modify string tension. For example, displacing the lever in a direction toward the guitar body causes string tension to decrease, resulting in a drop in the pitch. Conversely, displacing the lever in a direction away from the guitar body causes string tension to increase, resulting in an increase in the pitch. When the player releases the lever, the bridge returns to an equilibrium position due to the biasing effect of springs configured to counterbalance the tension of the guitar strings attached to the bridge. The neutral position is the position in which the guitar is tuned for normal play.

Because of the space required for the biasing levers and springs, floating type tremolo bridges are generally mounted to a guitar by routing or drilling the guitar body, or other similar operations. Unfortunately, this can be time-consuming and difficult, can cause undesirable changes to the body of the guitar and does not work well with hollow body guitars. Also, the mounting is typically permanent.

In addition, a tremolo that is based on a biasing system to return the bridge to the neutral state of equilibrium is extremely sensitive. String tension and biasing spring tension must be equilibrated to maintain pitch in the guitar. Therefore, if a string breaks, the overall string tension decreases, the equilibrium is upset, and the guitar goes out of pitch. Even placing a hand on floating type tremolo or damping strings while playing can upset the string/spring equilibrium. The guitar's tuning becomes out of order if the tremolo body is not completely restored to its neutral state of equilibrium after swinging the tremolo body.

In addition, the floating type tremolo bridge can make changing strings tedious and awkward and makes the initial tuning difficult. In general, tuning any one string creates a slight change in the tuning of the other strings. Thus, each string must be individually tuned and retuned multiple times in order to reach a satisfactory pitch relationship. Similarly, when a musician attempts to finger bend individual strings, the tune of the open notes is changed slightly, because any change in the tension of a single string moves the equilibrium point of the tremolo mechanism.

In the Rose U.S. Pat. Nos. 4,171,661 and 4,497,236, two improvements were established. In one improvement, the beveled ridge portion of the base plate was arranged so that it could be received and held in a tapered slot between the head of the screw and a flanged shoulder, thereby increasing the range of pitch change and improving the return to the initial tuned position and provided for lateral height adjustment of the tremolo. The other improvement involved functionally and physically integrating the bridge elements with the known art of combining fine tuners with anchoring means. In effecting the fine tuning, the bridge elements were provide with a constant radius, so that harmonic tuning would not be affected when establishing fine tuning. However fine tuning is limited to a range of about two musical pitches and is inadequate for bringing the strings to roper pitch for compensating string stretch, or achieving common alternate tuning commonly requiring a larger range of pitch change.

In the Shibuya U.S. Pat. No. 4,383,466, a pin was located in a hinge pivot to improve the return to the initial tuned position. This arrangement did not offer lateral height adjustment of the base plate and the field of rotation was not as great as in the Rose improvement.

U.S. Pat. No. 4,648,304 to Hoshino discloses a tremolo device wherein the strings are affixed to a series of reels that are rotated by means of a lever. The reels are not eccentric and depend on biasing action of a spring to maintain the reels in the neutral position. Hence, this device suffers from the defect inherent in all tremolos that rely on spring action to counter the biasing effect of the string tension.

It would thus be advantageous if a tremolo bridge on a guitar could be installed without drilling or routing the guitar, could be easily installed and removed, could maintain the pitch of the guitar when activated, and if strings are broken, could facilitate replacement of strings for the guitar.

SUMMARY OF THE INVENTION

Thus, it is an object of the present invention to provide a device that can vary the string tension of a stringed instrument and maintain the pitch of the guitar when the tension of one or more strings is varied or when a string breaks.

It is a further object of the invention to provide a device that can vary the string tension of a stringed instrument and will maintain the pitch of the guitar when it is operated.

In accordance with the preferred embodiment of the present invention, a device is provided having a base plate configured for attachment to a guitar body, a camshaft, cam stops against which the lobes of the camshaft ride, a slide plate to which the guitar strings are attached and which is moved by manipulating the camshaft, and a handle or other means for manipulating the camshaft. As with all tremolo devices, operation of this tremolo device changes string tension, but not string length. Strings for the guitar are engaged to respective string saddles and pass through respective slots in the slide plate. The string saddles are connected to the slide plate. The tension of the strings draws the slide plate toward the head of the guitar and hence brings the camshaft into contact with the cam stops. In one embodiment, a handle is connected to a lifter, which is connected to the camshaft. The device is mounted on the guitar body in such a manner that the long axis of the camshaft is generally perpendicular to the long access of the guitar. In response to moving the handle, the lifter moves, rotating the camshaft around its longitudinal axis. The camshaft surfaces in contact with the cam stops are formed so that the longitudinal axis of the camshaft moves closer or further from the head of the guitar as the camshaft rotates. The slide plate moves with the camshaft, thereby decreasing or increasing, respectively, the tension on the strings and creating the desired tremolo effect.

BRIEF DESCRIPTION OF THE DRAWINGS

The nature and mode of operation of the present invention will be more fully described in the following detailed description of the invention taken with the accompanying drawing figures, in which.

DETAILED DESCRIPTION OF THE INVENTION

Figure 1:
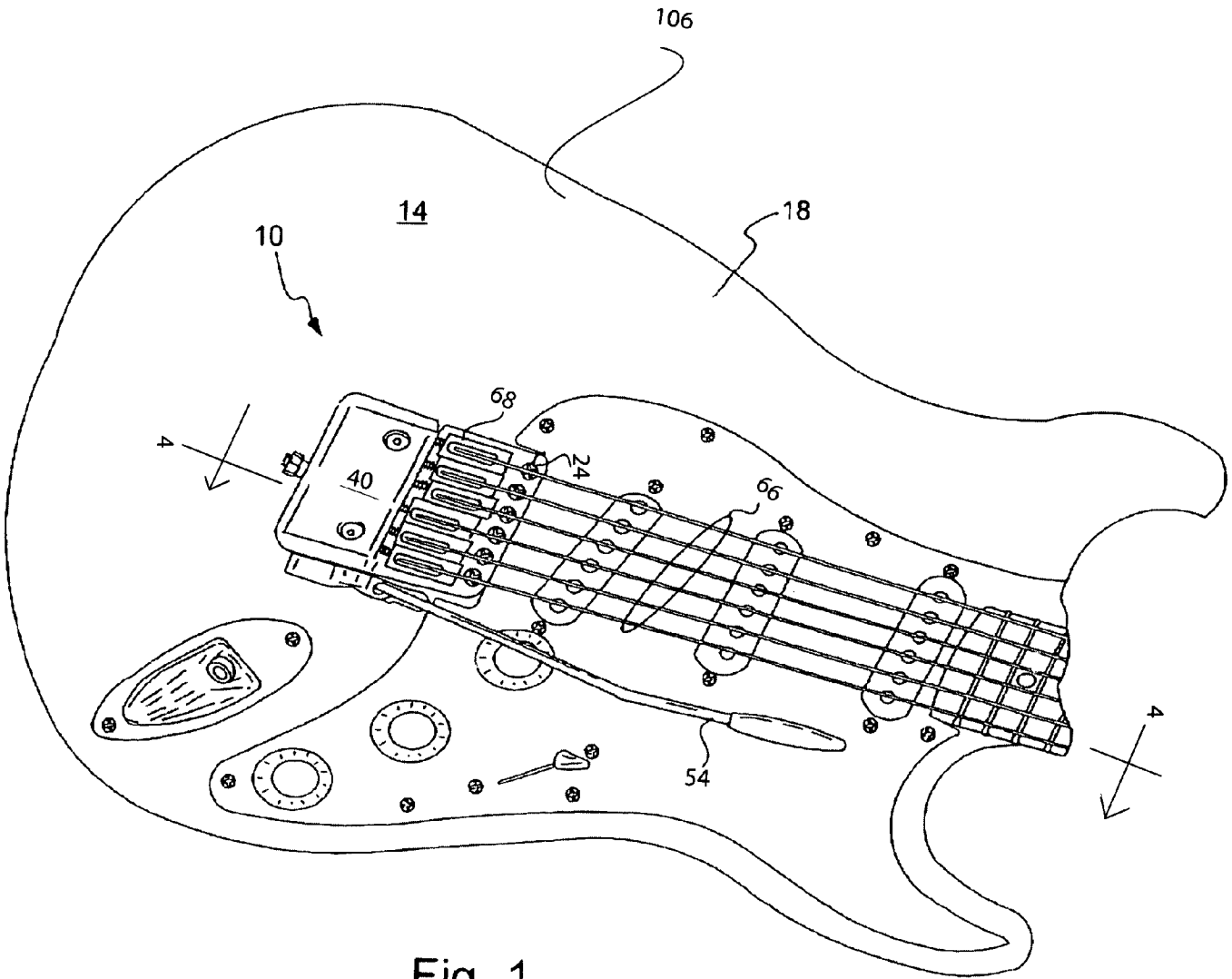
FIG. 1 is a perspective view of a present invention reverse tremolo bridge installed on an electric guitar.
Figure 2:
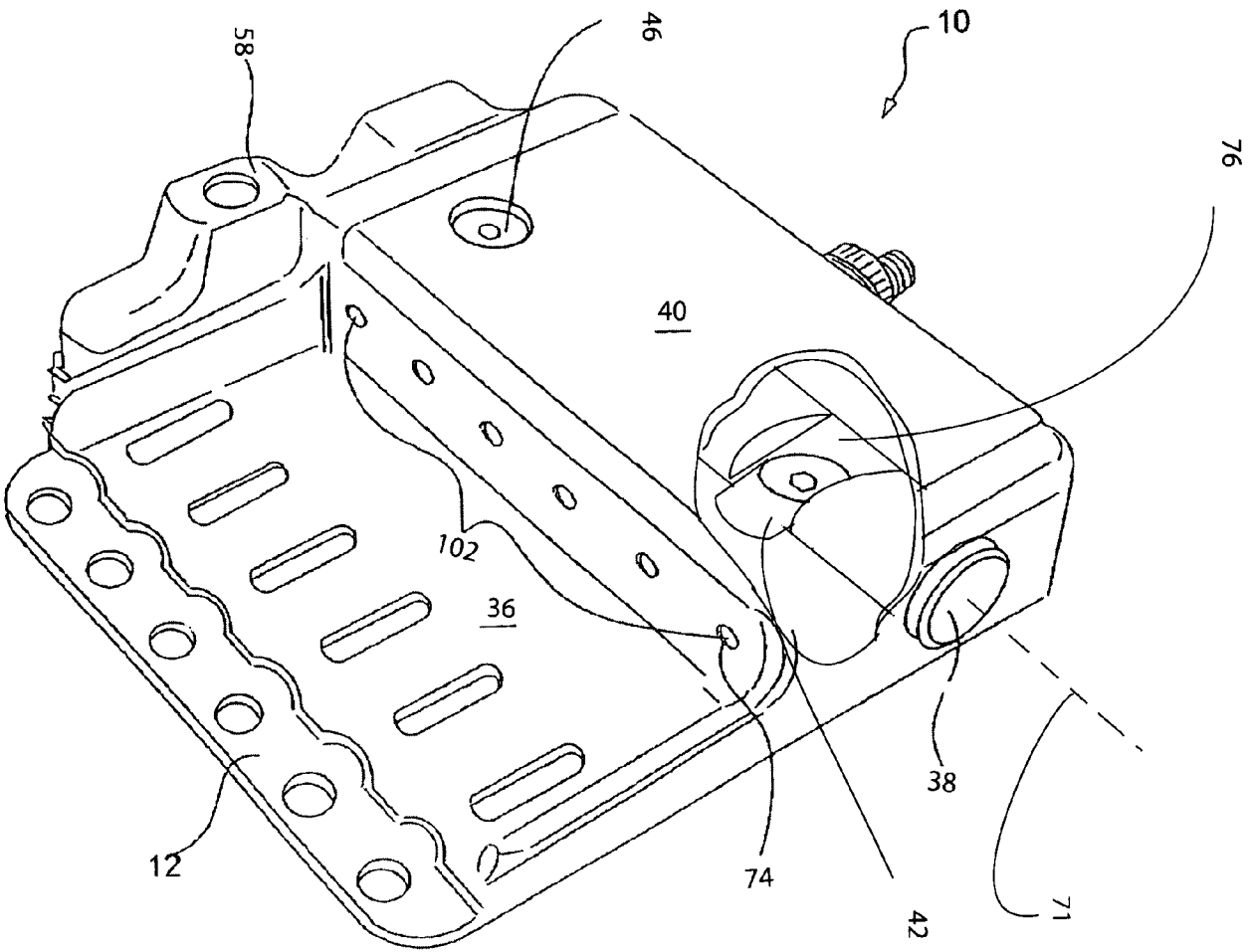
FIG. 2 is a perspective cutaway view of the bridge shown in FIG. 1.

At the outset, it should be appreciated that like drawing numbers on different views identify identical structure elements of the invention. While the present invention is described with respect to what is presently considered to be the preferred embodiments, it is understood that the invention is not limited to the disclosed embodiments.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

The following should be viewed in light of FIGS. 1 through 4. Tremolo bridge 10 includes base plate or deck plate 12 that connects bridge 10 to guitar 14. In some aspects, tremolo bridge 10 is retrofitted to replace a previously installed bridge (not shown) and base plate 12 is installed in essentially the same position as the previously installed bridge. In some aspects, bridge 10 is installed on a guitar that does not have an existing tremolo bridge. Base plate 12 includes holes 16, which are used to attach the tremolo bridge 10 to the guitar body 18. In one embodiment, the holes 16 are used to attach a spring block 20 to base plate 12 using screws or other fastening device. The spring block 20 is connected to guitar body 18 using springs 22.

It should be understood that the present invention can be used with any combination of spring blocks 20 and springs 22 known in the art, and is not limited to any particular combination of spring block 20 and springs 22 shown in the art, is not limited to any particular combination of spring block 20 and springs 22.

Screws 24 are placed through holes 26 and engaged with body 18. Chamfer 28 on front edge 30, enables base plate 12 to pivot about front edge 30 (formed by the intersection of a bottom surface 32 of base plate 12 and chamfer 28) in low tremolo. That is, rear edge 34 of base plate 12 moves away from body 18. Screws 24 are tightened to a degree allowing the swiveling of base plate 12 about edge 30. In some aspects, base plate 12 moves 15 degrees with respect to body 18. When tremolo bridge 10 is not being used to generate a tremolo effect, or when tremolo bridge 10 is being used for high tremolo, the spring block 20 pulls base plate 12 into contact with guitar body 18 to enable a desirably large sustain through the guitar body 18.

Tremolo bridge 10 also includes slide plate 36, camshaft 38, bracket 40, and cam stops 42. Camshaft 38 is attached to slide plate 36 using holes 44 in slide plate 36 and rotates in holes 44 as further described below. Screws 46 pass through holes 48 in bracket 40 and holes 50 in cam stops 42 and thread into holes 52 in base plate 12. Screws 46 hold cam stops 42 and bracket 40 in a stationary position with respect to slide plate 36. Handle 54 is connected to hole 56 in lifter 58. Camshaft 38 engages with hole 60 in lifter 58 and is held in place by setscrew 62 and cotter pin 64. It should be understood that other means known in the art can be used to hold camshaft 38 in place.

Respective guitar strings 66 pass through string saddles 68, slots 70 in slide plate 36, and slots 72 in base plate 12 to the spring block 20. Respective string saddles 68, are connected with screws (not shown) through holes 74 in slide plate 36. It should be understood that any string saddle known in the art can be used for string saddles 68 and that the present invention is not limited to any particular string saddle 68. Due to the tension on strings 66, the strings 66 are biased toward the head (not shown) of the guitar, that is, away from camshaft 38, and engage the respective spring saddles 68. The resulting tension on the string saddles 68 biases slide plate 36 toward the guitar head. Bridge 10 and strings 66 are maintained in this afore-mentioned "neutral" position when no pressure is applied to handle 54. In the neutral position described above, slide plate 36 is biased toward the head of the guitar, pulling camshaft 38 into contact with cam stops 42. Thus, surfaces 76 of camshaft 38 engage surfaces 78 of cam stops 42. In some aspects, surfaces 78 of cam stops 42 present a concave surface with respect to surfaces 76 of camshafts.

In the embodiment depicted in FIGS. 1-4, the low tremolo is obtained by displacing the handle 54 in a direction toward the guitar body 18. This action causes the lifter 58, to engage the base plate 12 which, in turn, causes the base plate 12 to pivot about edge 30 such that the rear edge 34 of base plate 12 moves away from body 18. To obtain high tremolo effect, handle 54 is displaced in a direction away from the guitar body 18, causing camshaft 38 to turn around its axis of rotation 71. The surfaces 76 of camshaft 38 are shaped such that the portions of surfaces 76 in contact with cam stops 42 have a varying radial distance from axis of rotation 71. That is, the radius of surface 76 increases as the cam 38 is moved around its axis of rotation 71. The cam 38 is in a neutral position when it is positioned such that the camshaft surface 76 with the smallest radial distance from the axis of rotation 71 abuts the cam stop surface 78. As the handle 54 is displaced in a direction away from the guitar body 18, the camshaft 38 turns on its axis of rotation 71. As the camshaft 38 turns on its axis of rotation 71, the radius of the surface 76 increases. The increase in the radius of surface 76 causes axis 71 to move away from cam stops 42, which are stationary with respect to camshaft 38. As camshaft 38 moves away from cam stops 42, slide plate 36, attached to camshaft 38, is displaced in a direction distal from the head of the guitar. In turn, string saddles 68, attach to slide plate 36 move away the head of the guitar, increasing tension in strings 66 and creating the desired high tremolo effect. When the tension on the handle 54 is released, the variable radial distances of the camshaft 38 combine with the string 66 tension to force the camshaft 38 to rotate to the neutral position, that is, the position where the camshaft surface 66 with the smallest radial distance from the axis of rotation engages the cam stop surface 68.

Figure 3:
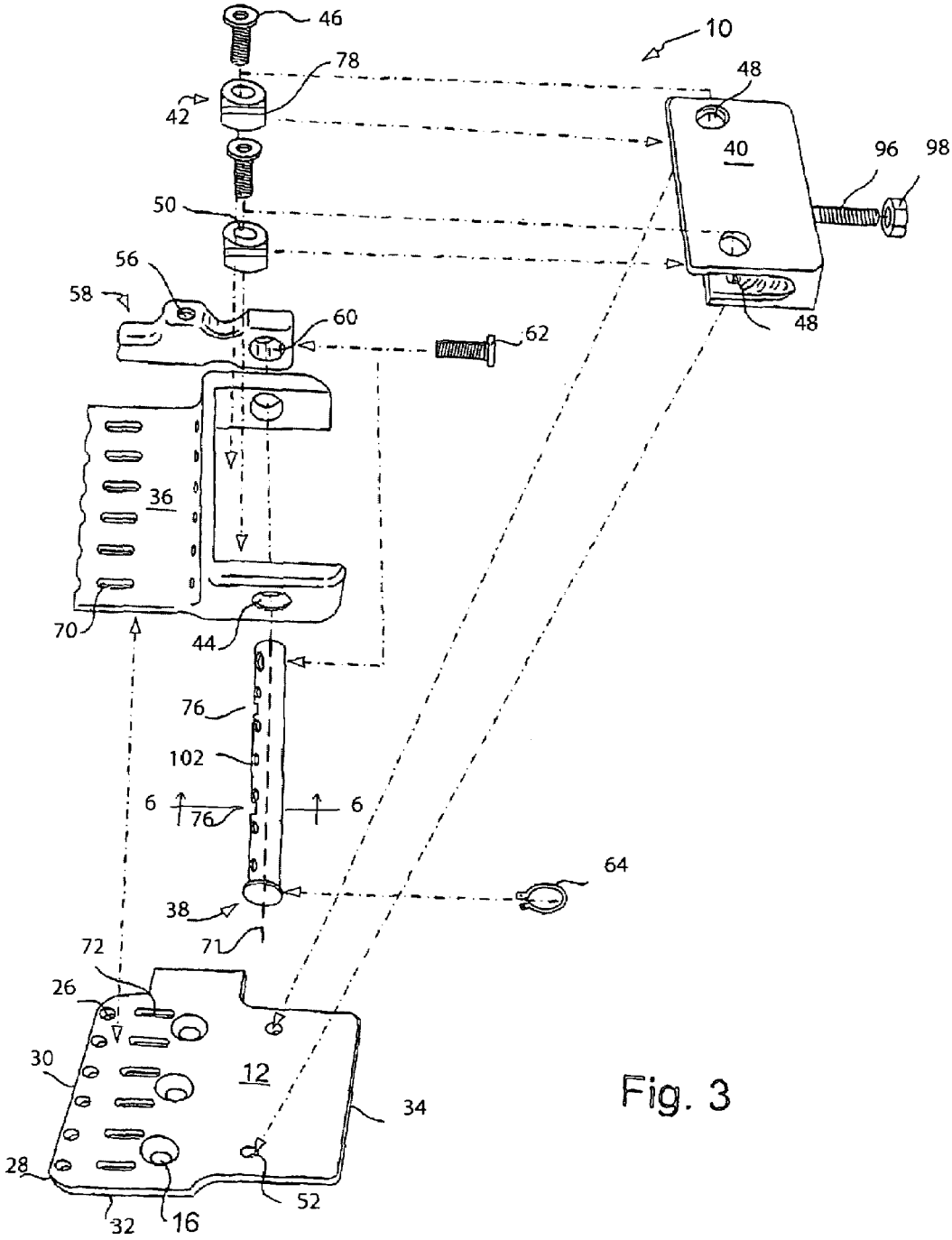
FIG. 3 is an exploded, perspective view of the bridge shown in FIG. 1
Figure 6:
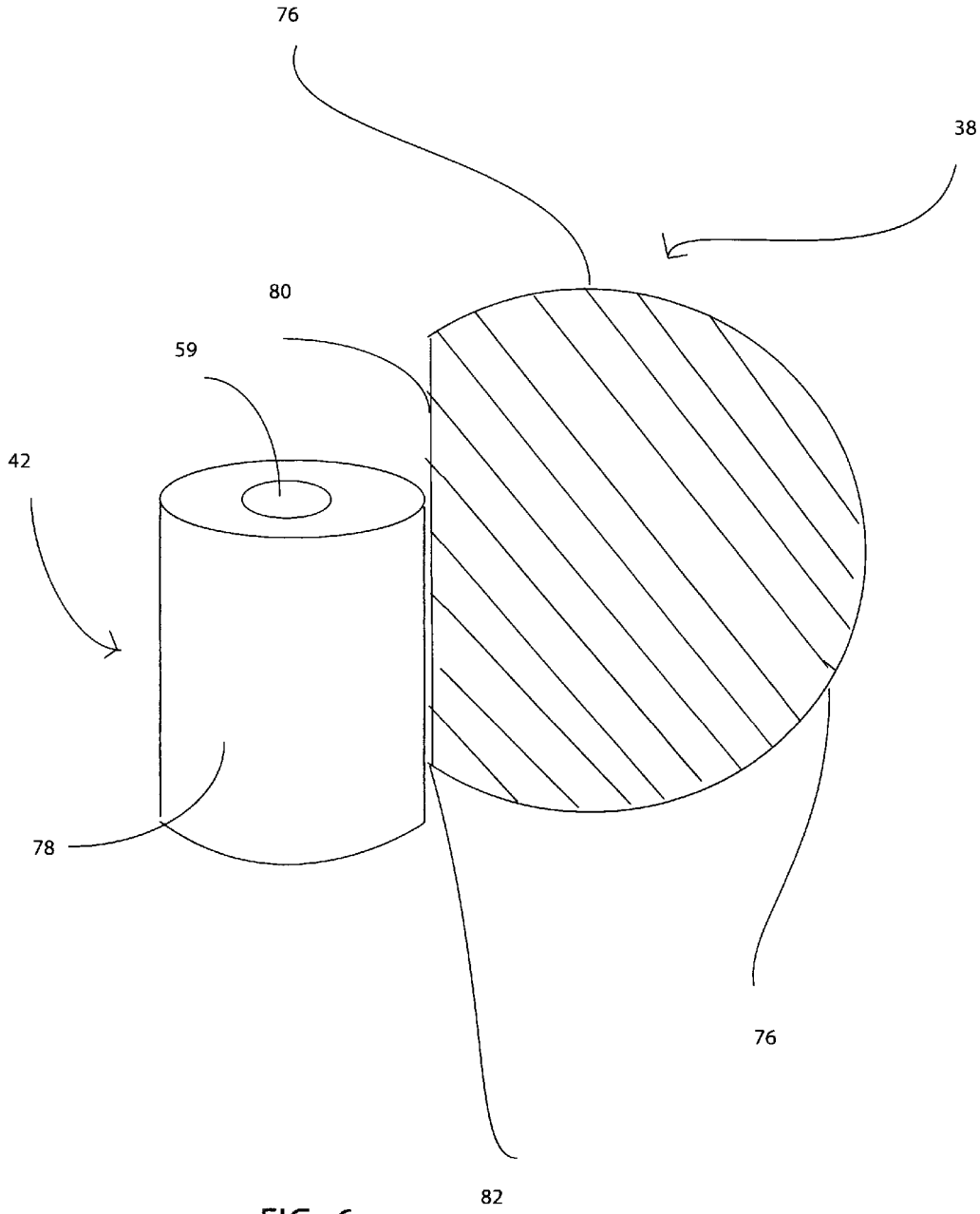
FIG. 6 is a cross-section view of the camshaft taken along a line 6-6 of FIG. 3 depicting the camshaft in the neutral position with regard to the cam stop.
Figure 7:
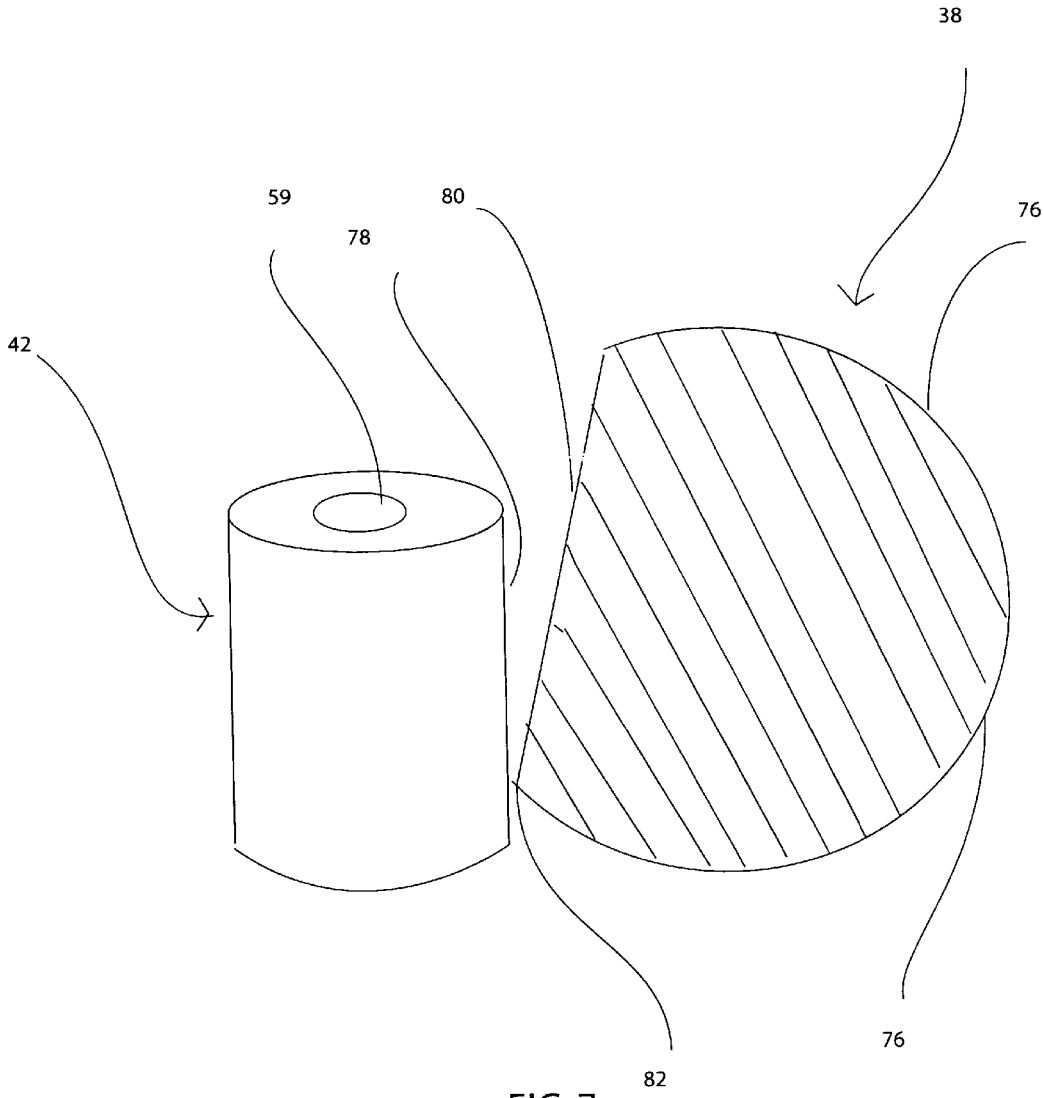
FIG. 7 is a cross-section view of the camshaft taken along a line 6-6 of FIG. 3 depicting the camshaft in the high tremolo position with regard to the cam stop.

FIG. 6 is a cross-sectional view of the camshaft taken along a line 6-6 of FIG. 3 depicting the camshaft in the neutral position with regard to the cam stop. FIG. 7 is a cross-sectional view of the camshaft taken along a line 6-6 of FIG. 3 depicting the camshaft in the high tremolo position with regard to the cam stop. As these figures illustrate, the cam surface 76 is closest to the head of the guitar (not shown) when the cam shaft 38 is in the neutral position as depicted in FIG. 6. The cam surface 76 has a beveled flat portion 80 that contacts the cam stop 42 when in the neutral position. As depicted in FIGS. 6 & 7, the cam has a fulcrum point 82 where the flat beveled surface 80 ends. When the cam shaft 38 is rotated as depicted in FIG. 7, this fulcrum point 82 engages the cam stop 42 and levers the cam shaft 38 such that the cam shaft surface 76 moves away from the cam stop 42.

Figure 8:
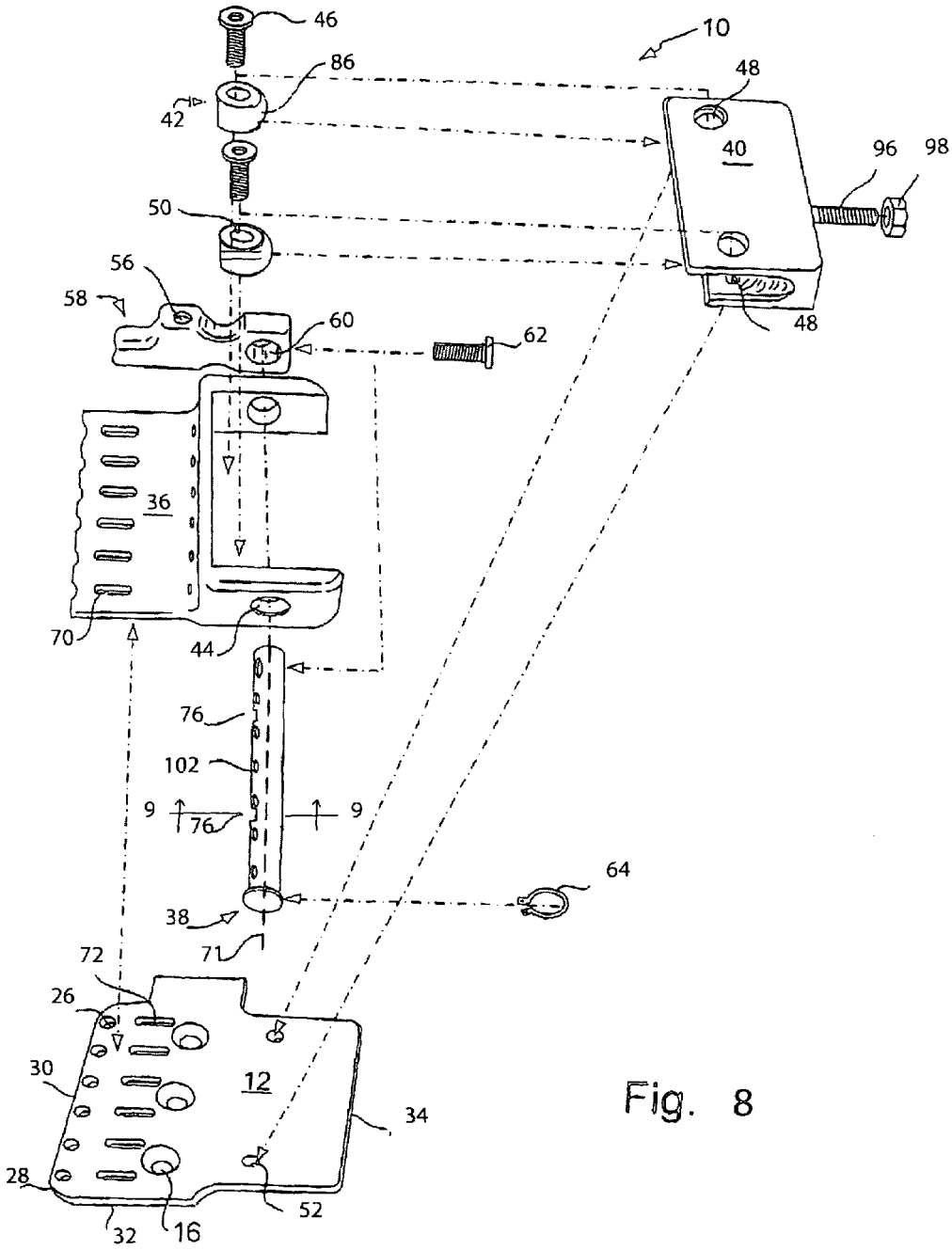
FIG. 8 is an exploded, perspective view of the bridge shown in FIG. 1 possessing an alternative design for the camshaft and cam stops.
Figure 9:
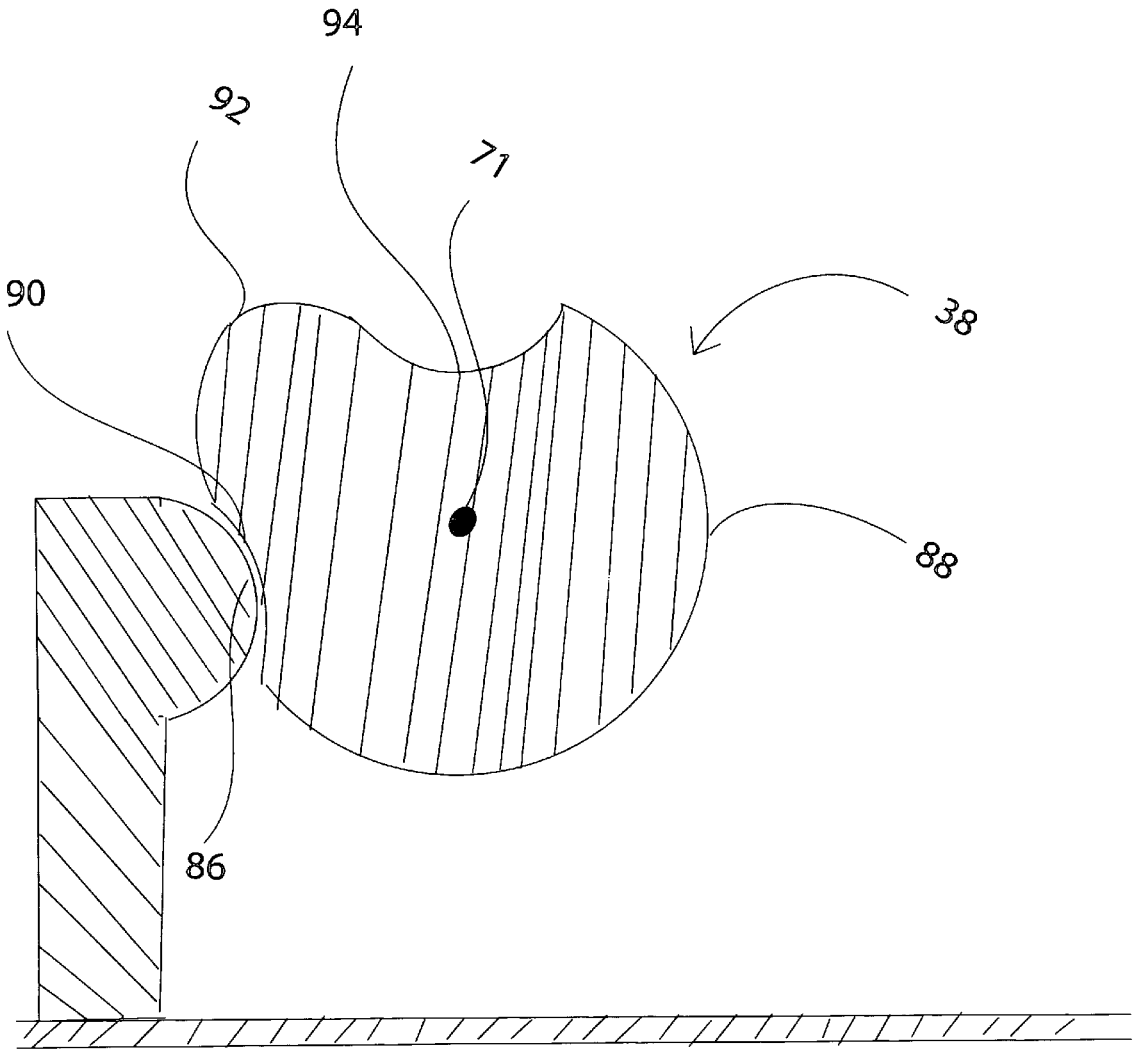
FIG. 9 is a cross-section view of the camshaft taken along a line 9-9 of FIG. 8.
Figure 10:
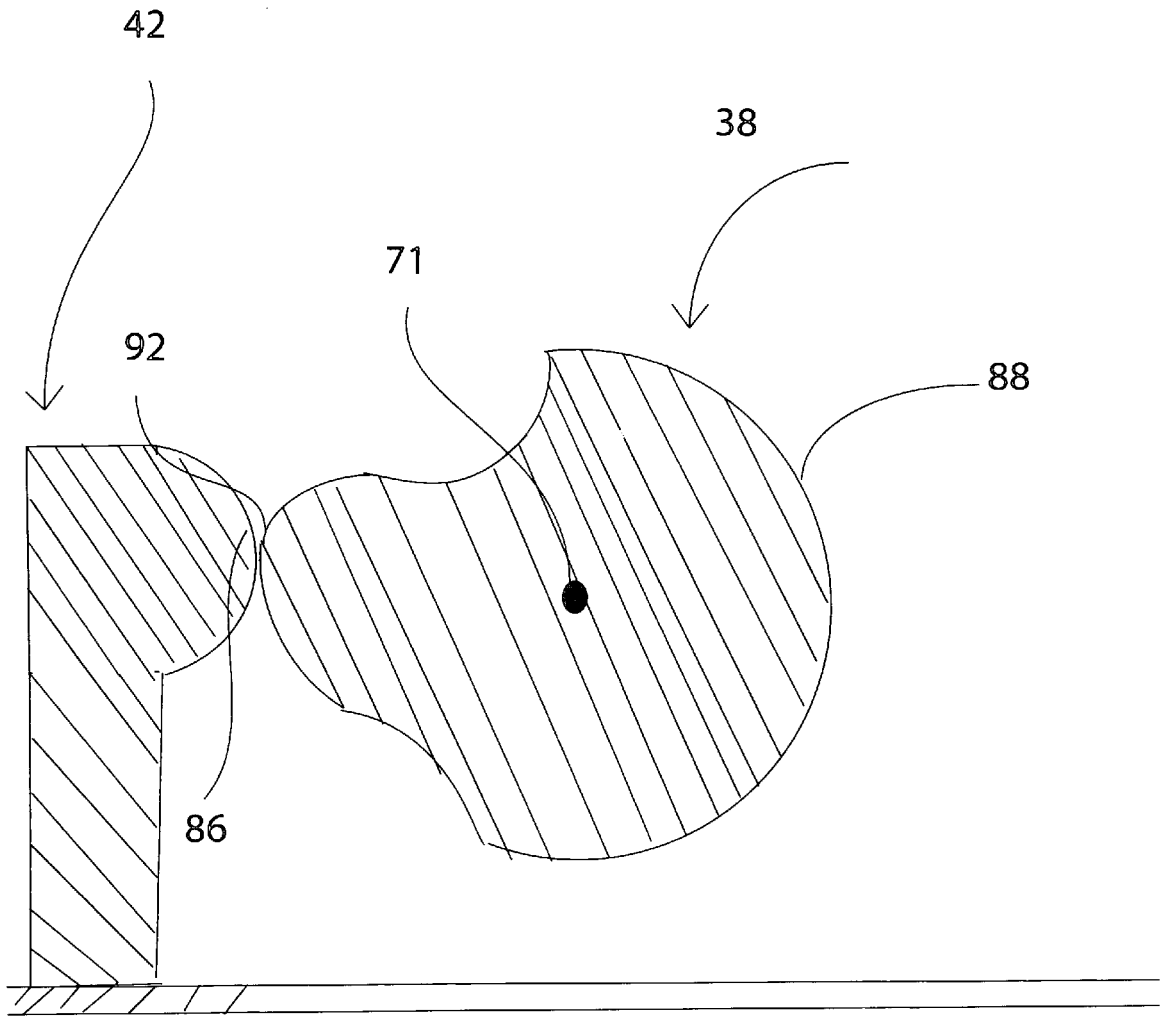
FIG. 10 is a cross-section view of the camshaft taken along a line 9-9 of FIG. 8.
Figure 11:
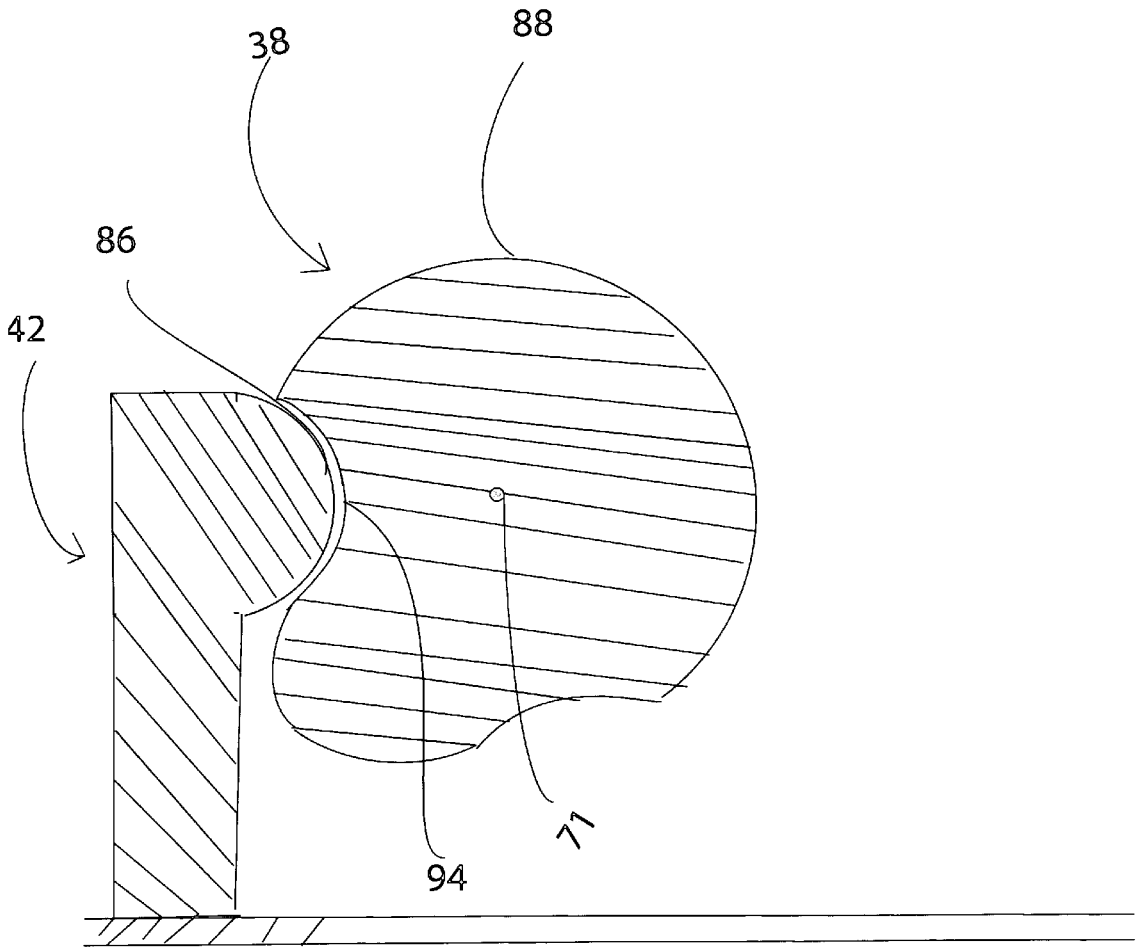
FIG. 11 is a cross-section view of the camshaft taken along a line 9-9 of FIG. 8.

FIG. 8 shows an alternative embodiment in which, camshaft 38 is shaped in such a manner that both high and low tremolo effect is initiated by cam action without the use of springs. FIGS. 9-11 show a cross section of this camshaft 38 design. In this embodiment, the camshaft 38 is milled in such a manner that the surface 88 of the camshaft 38 changes from having a relatively large radial distance from its axis of rotation 71 to its surface 88 (hereinafter the "radial distance") to having a relatively small radial distance within a relatively small number of degrees of arc.

The cam stops 42 depicted in FIG. 8 have a convex surface 86 to accommodate the camshaft 38 shape. In the cross sectional views depicted in FIGS. 9-11, the surface 88 of the camshaft 38 changes within a relatively small number of degrees of arc from a first point 90 whose radius is a defined distance from its axis of rotation 71. The first point 90 engages the surface 86 of the cam stop 42 when the camshaft 38 is in the neutral position. When the camshaft 38 is turned around its axis of rotation 71, the radial distance increases with respect to the radial distance at point 90 until the radial distance reaches a maximum value at a second point 92. This increase in radial distance causes the camshaft 38 to move in a direction away from the guitar head (not shown) resulting in the high tremolo effect. As the camshaft 38 is rotated further around its axis of rotation 71, the radial distance decreases until it reaches its minimum value at a third point 94. This decrease in radial distance causes the camshaft 38 to move in a direction toward the guitar head, resulting in the low tremolo effect.

The design of this camshaft allows the handle 54 to be displaced in a direction either toward the guitar 14 or away from the guitar 14. This displacement, in turn, causes the camshaft 38 to rotate counterclockwise or clockwise. The radial distance decreases when the camshaft 38 is rotated in one direction from the neutral position. As the radial distance decreases, the camshaft 38 moves closer to cam stops 42, and slide plate 36, attached to camshaft 38, slides in the same direction. As a result, string saddles 68, with which strings 66 are in contact, also move toward the head of the guitar, decreasing tension in strings 66 and creating the desired low tremolo effect.

When the camshaft 38 is rotated in the opposite direction, the radial distance increases. As the radial distance increases, the camshaft 38 moves farther from the cam stops 42 and slide plate 36, attached to camshaft 38, slides in the same direction. As a result, string saddles 68, with which strings 66 are in contact, also move away from the head of the guitar, increasing tension on strings 66 and creating the desired high tremolo effect.

It should be understood that cam stops 42 and camshaft 38 also can be configured so that a low tremolo effect is created by pulling handle 54 away from guitar body 18 and a high tremolo effect is created by pushing handle 54 toward guitar body 18.

Figure 5:
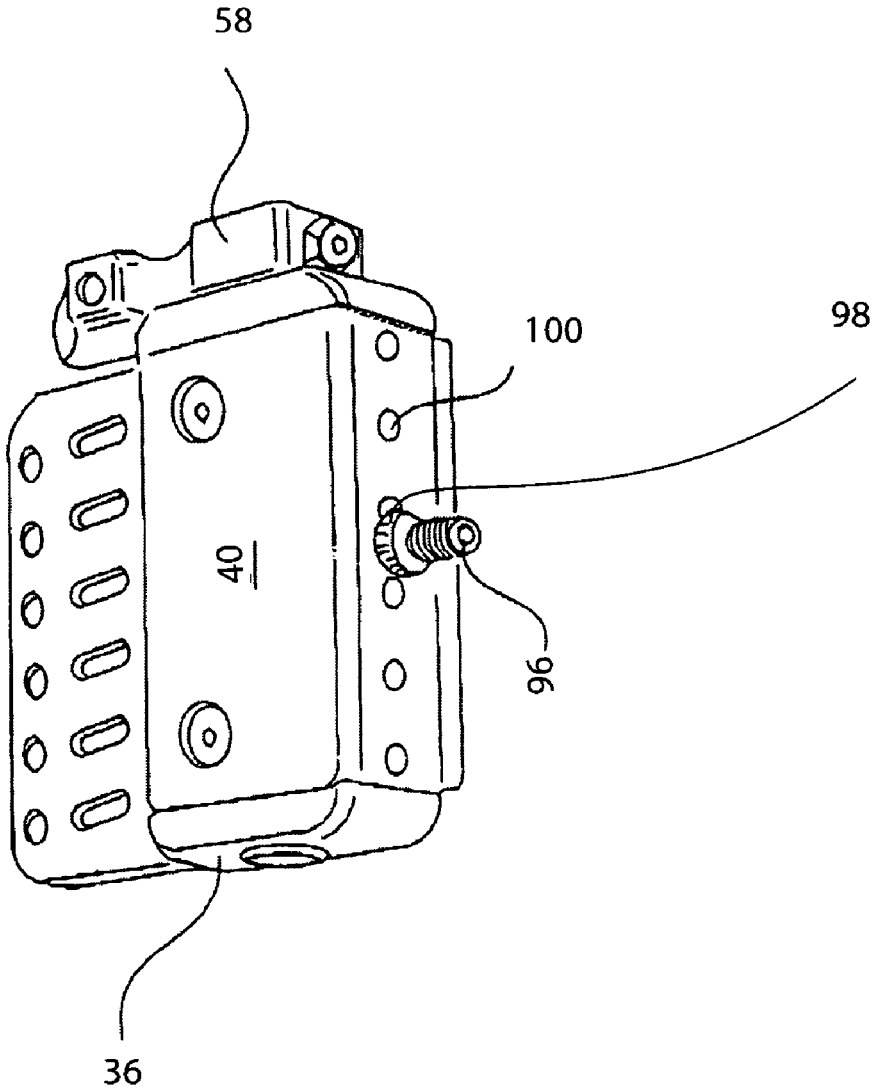
FIG. 5 is a perspective rear-view of the bridge shown in FIG. 1.

In another embodiment, depicted in FIG. 5, a setscrew 96 can be threaded through bracket 40 to engage camshaft 38 and limit the clockwise rotation of camshaft 32. Nut 98 is used to hold setscrew 96 in a desired position. It should be understood that bridge 10 can be operated without using setscrew 96.

The following should be viewed in light of FIGS. 1 through 5. Holes 100 in the back of bracket 40 allow access to intonation adjustment screws (not shown) in string saddles 68. Holes 102 in camshaft 38 are aligned with holes 100 and the respective intonation adjustment screws of string saddles 68 to enable an adjustment tool to pass through holes 100 and 102 to reach saddles 68. In some aspects, holes 100 are arranged to align with holes 98 and the intonation adjustment screws when bridge 10 is in the neutral position.

Bridge 10 can be configured to accommodate any string spacing known in the art. For example, in some aspects, width 104 for holes 74 in slide plate 12, which is approximately equal to the string spacing, is approximately 2 3/16 inches. In some aspects, width 104 is approximately 53 mm.

The components of bridge 10 can be made of any material known in the art. In some aspects, base plate 12, slide plate 36, bracket 40, and lifter 58 are made of aluminum. In some aspects, the aluminum is 6061 aluminum. In some aspects, base plate 12 is made of tool steel. In some aspects, the tool steel is 0.02. In some aspects, camshaft 38 is casehardened.

Figure 4:
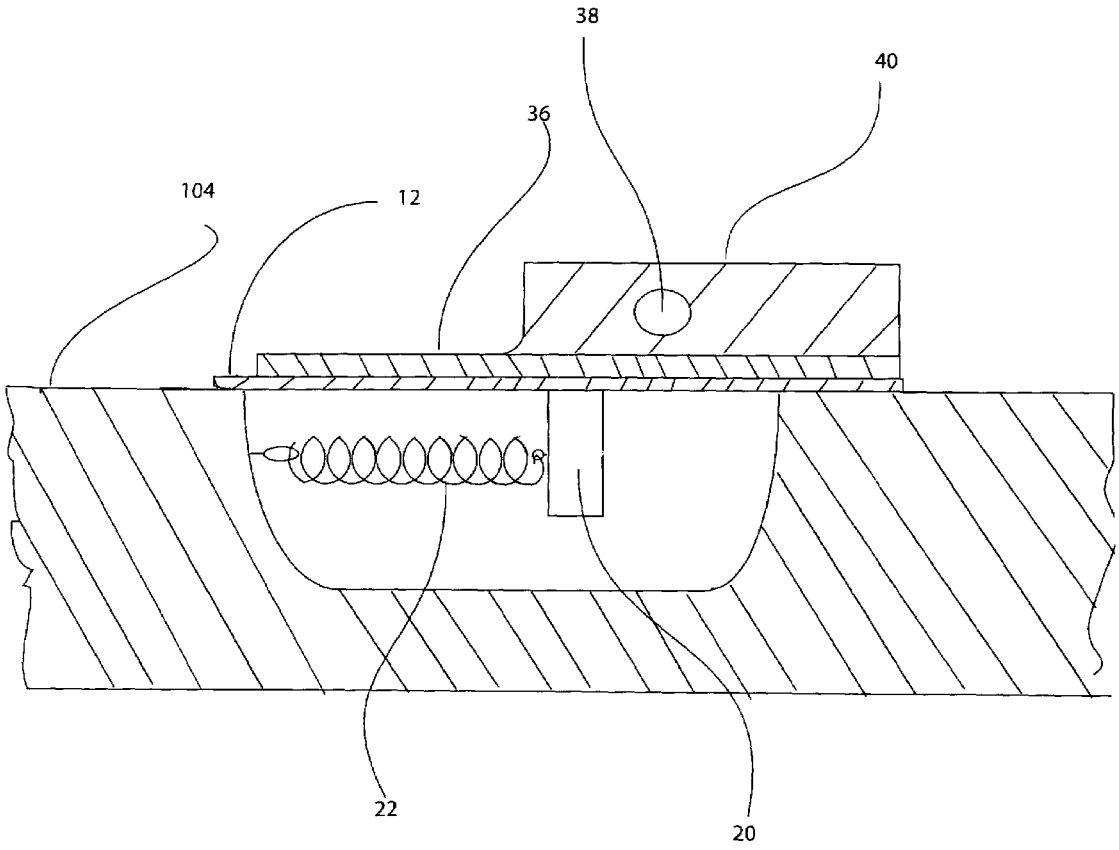
FIG. 4 is a cross-section view of the bridge taken along line 4-4 of FIG. 1

Tremolo Bridge 10 can also be mounted in the guitar body 18 in a position that is inverted from that depicted if FIG. 4. That is, the tremolo bridge 10 can be mounted in the guitar body 18 such that the bottom surface 32 of the base plate 12 faces in the same direction as the face 106 of the guitar 14 and is mounted more or less flush with the face 106 of the guitar. In this embodiment, the guitar body 18 must be recessed to receive the cam and the bracket.

Thus, it is seen that the objects of the invention are efficiently obtained, although modifications and changes to the invention may be readily imagined by those having ordinary skill in the art, and these changes and modifications are intended to be within the scope of the specification.

What is claimed is:

1. A tremolo device comprising:

a first plate secured in place on a stringed musical instrument body;

a second plate moveably affixed to the first plate to which the strings of the musical instrument may be affixed;

a camshaft situated to move the second plate with respect to the first plate;

a means for manipulating the camshaft such that when the camshaft is manipulated, the device increases and decreases the tension on the strings for a tremulous effect while playing the instrument.

2. The tremolo device of claim 1 further possessing at least one cam stop affixed to the said first plate and against the surface of which the surface of said camshaft rotates.

3. The tremolo device of claim 2 wherein the said camshaft is rotatably connected to the said second plate.

4. The tremolo device of claim 3 wherein the first plate possesses a means for attaching it to the body of a stringed instrument.

5. The tremolo device of claim 4 wherein the said second plate possesses a means for attaching it to the body of a stringed musical instrument.

6. A tremolo device comprising:

a first plate secured in place on a stringed musical instrument body;

a second plate moveably affixed to the first plate to which the strings of the musical instrument may be affixed;

a camshaft situated to move the second plate with respect to the first plate such that when the camshaft is manipulated, the device increases and decreases the tension on the strings for a tremulous effect while playing the instrument;

at least one cam stop affixed to the said first plate and against which the camshaft surface rotates;

a handle for manipulating the camshaft;

a means for affixing the strings of a stringed musical instrument to the said device; and, a means for affixing the device to the spring block of a guitar.

7. The tremolo device of claim 6 wherein the said camshaft rotates when the said handle is moved in a direction away from the guitar and wherein the said tremolo device pivots on the said spring block when the said handle is moved in a direction toward the guitar body.

8. The tremolo device of claim 7 further possessing at least one lifter situated in such a manner as to prevent the camshaft from turning when the handle is moved in a direction toward the guitar.

9. The tremolo device of claim 8 wherein the said lifter is so situated as to function as a lever with respect to the said first plate and cause it to pivot when the handle is moved in a direction toward the body of the guitar.

10. The tremolo device of claim 9 wherein the said camshaft is milled to have at least one flat surface.

11. The device of claim 10 wherein the said at least one flat surface rests against the said cam stop when the said camshaft is in a neutral position.

12. A tremolo device comprising:

a first plate secured in place on a stringed musical instrument body;

a second plate moveably affixed to the first plate to which the strings of the musical instrument may be affixed;

a camshaft situated to move the second plate with respect to the first plate such that when the camshaft is manipulated, the device increases and decreases the tension on the strings for a tremulous effect while playing the instrument;

at least one cam stop affixed to the said first plate and against which the camshaft surface rotates;

a means for manipulating the camshaft; and wherein the said camshaft is shaped such that it moves in one direction laterally with respect to the said at least one cam stop when the camshaft is rotated in one direction and moves in the opposite direction laterally with respect to the said at least one cam stop when the said camshaft is rotated in the opposite direction.

13. A tremolo device comprising:

a first plate secured in place on a stringed musical instrument body;

a second plate moveably affixed to the first plate to which the strings of the musical instrument may be affixed;

a camshaft situated to move the second plate with respect to the first plate such that when the camshaft is manipulated, the device increases and decreases the tension on the strings for a tremulous effect while playing the instrument;

at least one cam stop affixed to the said first plate and against the surface of which the camshaft surface moves;

a means for manipulating the camshaft; and, wherein the said camshaft is shaped such that it alternately moves toward and away from the said at least one cam stop when the said camshaft is rotated.

14. The device of claim 13, further comprising a means for affixing the strings of a stringed musical instrument to the said device.

* * * * *